US005191681A

United States Patent [19]

Lokken

[11] Patent Number: 5,191,681

[45] Date of Patent: Mar. 9, 1993

[54] NAPKIN- OR DRAPE-HOLDER

[76] Inventor: Oddvin Lokken, 131 Forest Ave., Rye, N.Y. 10580

[21] Appl. No.: 849,486

[22] Filed: Mar. 11, 1992

[51] Int. Cl.[5] ..... A45F 5/00

[52] U.S. Cl. ..... 24/9; 24/7

[58] Field of Search ..... 24/9, 7, 8, 61, 168, 24/171, 181, 487, 557; 2/152 R; 223/34, 81

[56] References Cited

U.S. PATENT DOCUMENTS

| | | | |
|---|---|---|---|
| 115,238 | 5/1871 | Raiford . | |
| 154,543 | 9/1874 | Decker et al. . | |
| 216,478 | 10/1879 | Weed . | |
| 383,847 | 6/1888 | Baker . | |
| 434,857 | 8/1890 | Adamson . | |
| 546,658 | 9/1895 | Dormitzer . | |
| 559,517 | 5/1896 | Dormitzer . | |
| 675,108 | 5/1901 | Perkins . | |
| 703,864 | 7/1902 | Walker . | |
| 868,817 | 10/1907 | Smith | 24/9 |
| 896,627 | 8/1908 | Daly . | |
| 921,680 | 5/1909 | Friok . | |
| 1,237,564 | 8/1917 | Seydel | 24/7 |
| 4,581,481 | 4/1986 | Moretti | 24/487 |
| 4,587,692 | 5/1986 | Kaderabek . | |
| 4,947,523 | 8/1990 | Robbins, III et al. | 24/487 |

*Primary Examiner*—Victor N. Sakran
*Attorney, Agent, or Firm*—Rosenman & Colin

[57] ABSTRACT

A napkin- or drape holder in the form of a one-piece molding, comprising:

a) a spring-like first plastic member having a body portion terminating in opposed proximal ends, the body portion being shaped to fit around the human neck;

b) a spring-like second plastic member having a body portion terminating in free ends, each of the free ends being connected to the body portion of the first member by integral plastic hinges;

c) the members have a normally open position in which they lie in planes oblique to one another and a closed position in which they are coplanar, the members being swingable about the hinges between these positions;

d) the members are operable when in the closed position to clamp a napkin in place inserted between the body portions thereof; and e) integral plastic locks carried by one of the members for releasably locking the members in the closed position.

4 Claims, 3 Drawing Sheets

FIG. 1
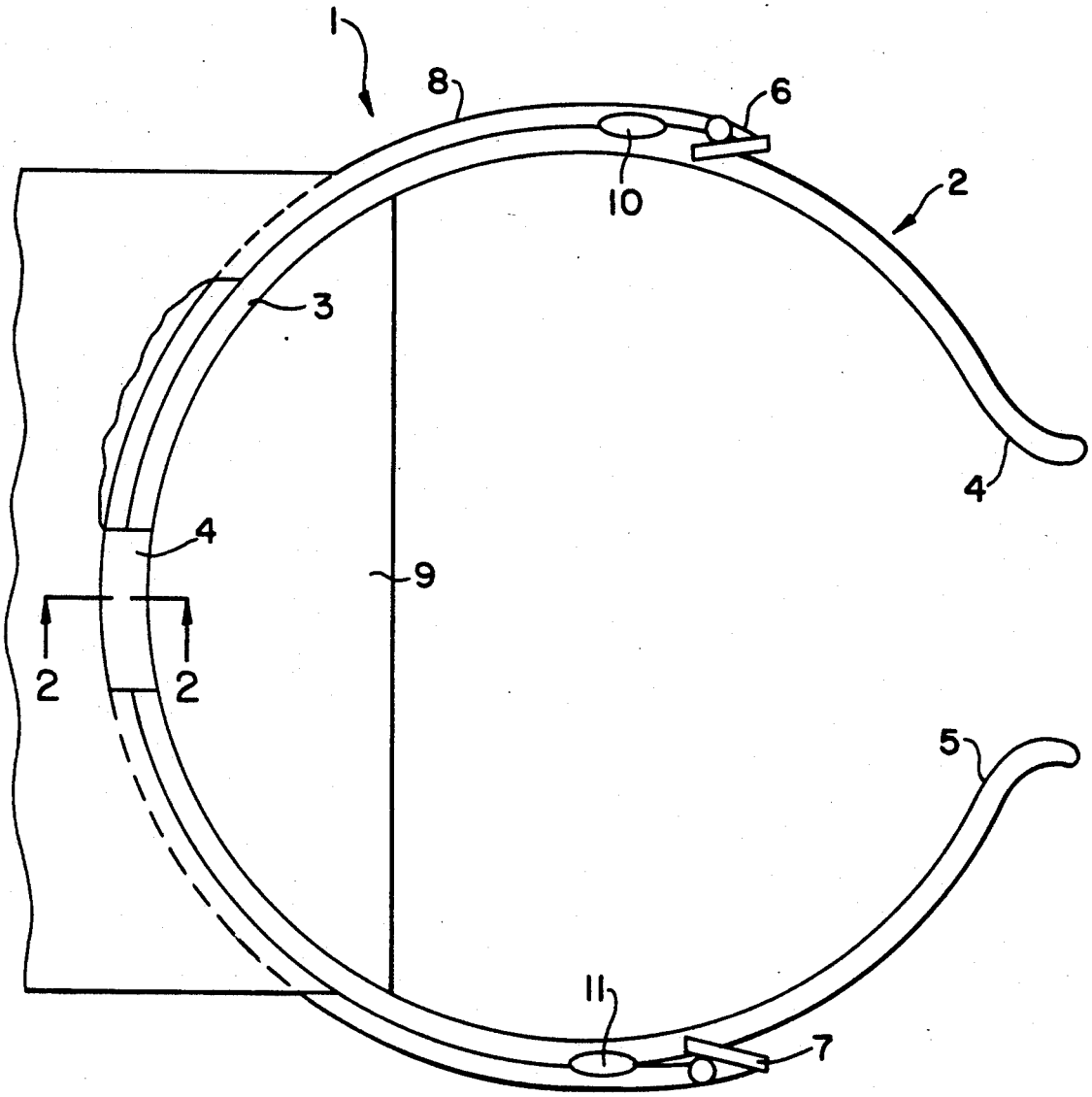
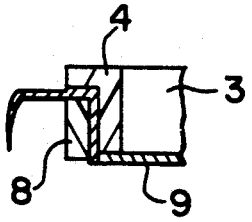
FIG. 2

NAPKIN- OR DRAPE-HOLDER

The present invention relates to a napkin- or drape-holder.

While the present invention finds particular utility in the health care field, such as for use by dentists, oral surgeons, ENT specialists and others who perform procedures in or on the mouth, its use is not so limited. For example, the present invention may also be sued by persons at mealtimes, such as airplane passengers, babies, patients in hospitals or old age homes and the like. Indeed, the present invention may be used in any instance where protection is desired by way of a napkin, bib or drape placed around the neck.

A wide variety of napkin holders have been proposed and are in use in the health care field. Commonly, a napkin or drape is held in place by a chain or the like having clips at both ends. While in widespread use, this chain system often leaves the napkin or drape too widely spaced from the user's neck to provide complete protection during use.

In these days of increased concern about the health hazards posed to dental practitioners, it would be desirable to provide a totally disposable napkin or drape system. That is, it would be preferable to provide a disposable napkin or drape as well as a disposable napkin- or drape-holder. Such a disposable napkin- or drape-holder would have to be inexpensive to manufacture, requiring the use of inexpensive materials and minimal labor costs.

The present invention now provides a low cost napkin- or drape-holder that can place the napkin or drape close to the user's neck. Moreover, the napkin- or drape-holder of the invention can be autoclaved and reused or can be disposable, if desired. The napkin- or drape-holder of the present invention is in the form of a one-piece plastic molding comprising: a) a spring-like first plastic member having a body portion terminating in opposed proximal ends, said body portion being shaped to fit around the human neck; b) a spring-like second plastic member having a body portion terminating in free ends, each of said free ends being connected to said body portion of said first member by integral plastic hinge means; c) said first and second members having a normally open position in which said members lie in planes oblique to one another and a closed position in which said members are coplanar, said members being swingable about said hinge means between said positions; d) said members being operable when in said closed position to clamp a napkin in place inserted between the body portions of said members; and e) integral plastic locking means carried by one of said members for releasably locking said members in said closed position. Since the napkin- or drape-holder of the present invention is formed in a single molding operation with all of its parts, no assembly is required. The holder of the present invention can thus be manufactured from inexpensive plastic with no labor costs for assembly. The holder of the present invention thus satisfies the demand for a disposable napkin- or drape-holder.

The present invention is illustrated in terms of a preferred embodiment in the accompanying drawings, in which:

FIG. 1 is a top plan view of the napkin- or drape-holder of the invention in the closed position with a napkin or drape clamped in place;

FIG. 2 is a view in section taken along lines 2—2 of FIG. 1;

Figure 3:
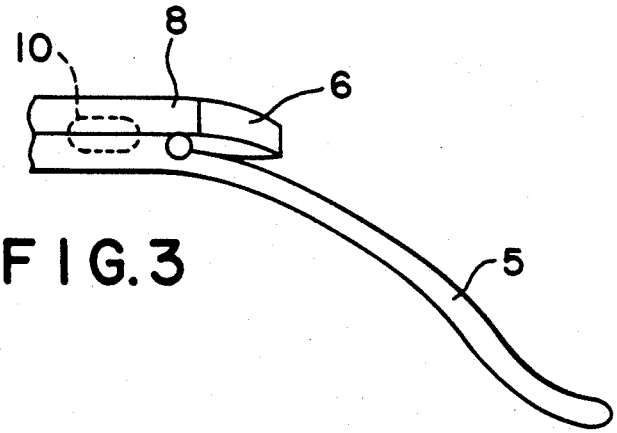
FIG. 3 is a partial bottom plan view of the holder of FIG. 1.

Referring to FIG. 1, the napkin- or drape-holder 1 has a spring-like member 2 having an arcuate body portion 3 terminating in inwardly turned proximal free ends 4,5. The ends 4,5 may be manually urged apart to fit member 2 around the neck of the user. Member 2 is shown as having a circular body portion 3, but other shapes adapted to the anatomy of the human neck can be used, such as oval or elliptal shapes. At the distal end of holder 2 is a flange 4, which will be described in detail hereinafter.

Attached to member 2 via living hinges 6,7 is cooperating member 8, which is complementary in shape to and coplanar with member 2 when in the closed position shown in FIG. 1. Member 8 fits snugly against member 2 when the holder 1 is in the closed position shown in FIG. 1. Securely gripped in the narrow space between members 2,8 is napkin or drape 9. Locking tabs 10,11 carried by the top edge of member 8 overlie the top edge of member 2 and thus lock the members 2,8 in the closed position shown in FIG. 1 by preventing member 2 from being swung upwardly out of the plane of the drawing (as viewed in FIG. 1) to the open position shown in FIG. 4, wherein members 2,8 lie in oblique planes.

Figure 4:
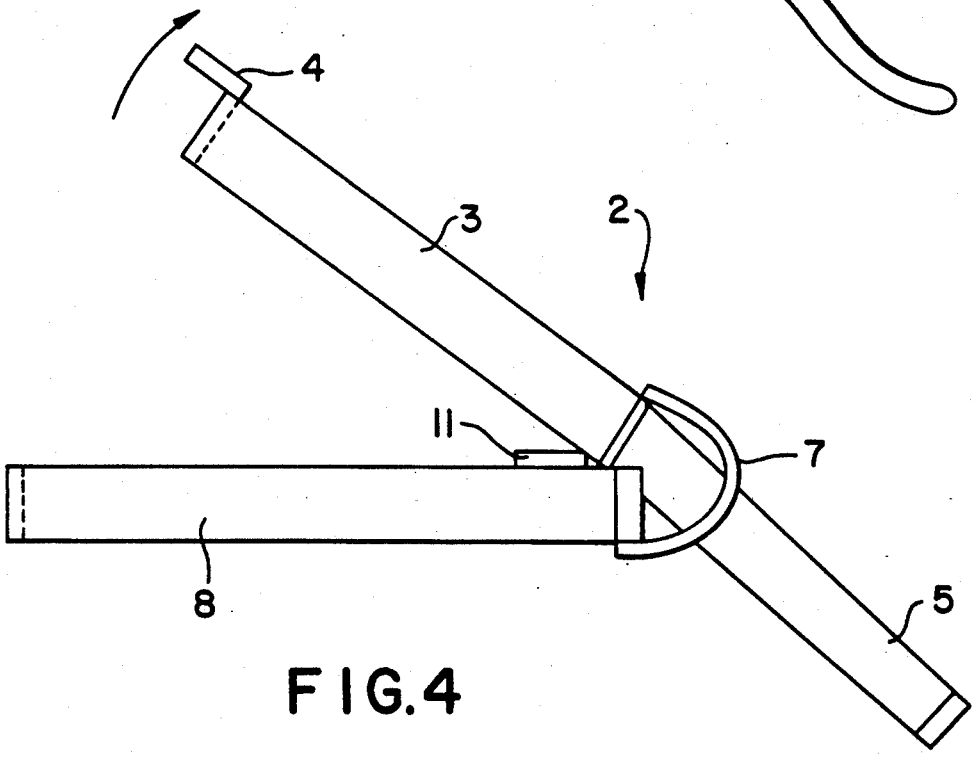
FIG. 4 is an elevational view of the holder being swung to the open position.

To open the holder 1, the member 2 is swung in the direction of the arrow shown in FIG. 4 relative to member 8. Initially, locking tabs 10,11 will resist such movement, but member 8 will flex outwardly and member 2 will flex inwardly to allow member 8 to swing free of locking tabs 10,11. The drape 9 (FIG. 1) can then be removed.

To insert a drape in the open holder 1, the drape 9 will be laid over holder 8 (as viewed in FIG. 4) and holder 2 will be swung toward holder 8 opposite to the direction of the arrow shown in FIG. 4. Again, the resilience of holders 2,8 will allow the locking tabs 10,11 to move outwardly and away from the top edge of holder 2. Flange 4 acts as a stop to locate holder 2 in its correct closed position relative to member 8, with the drape 9 securely locked in place between members 2,8.

Of course, locking tabs 10,11 can be located on the bottom edge of holder 2 so that they overlie the bottom edge of holder 8 in the closed position shown in FIG. 4. Likewise, flange 4 can be located on the bottom of holder 8.

Figure 5:
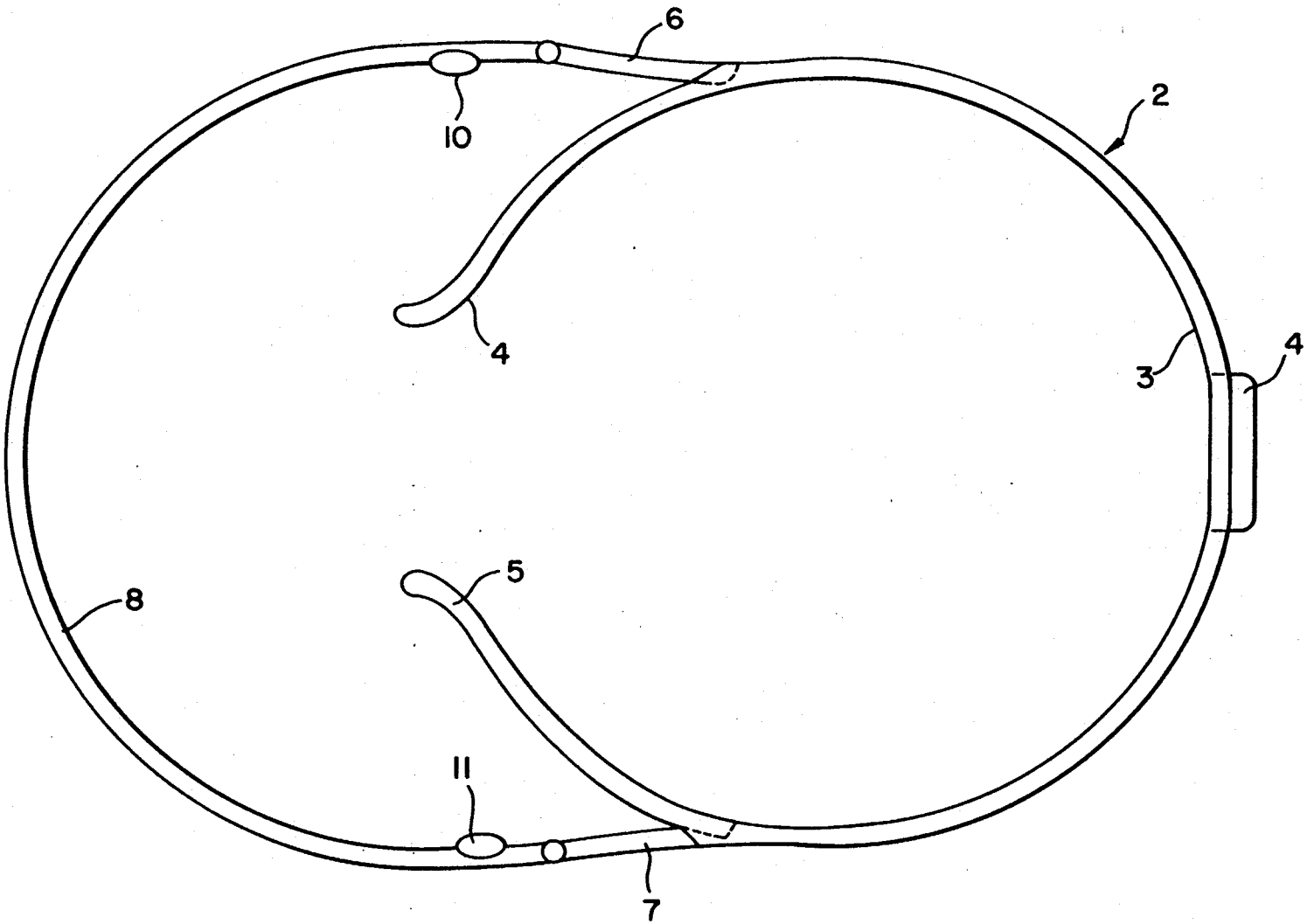
FIG. 5 is a top plan view of the holder in its as-molded form.

The holder 1 is a one-piece plastic molding. Any suitable plastic may be used, such as polyvinyl chloride or the like. Holder 1 is molded in one-piece, preferably in the configuration shown in FIG. 5, wherein members 2 and 8 are coplanar. Living hinges 6,7 have a "memory" and hence will urge members 2,8 apart to the as-molded open position. A single molding operation thus forms all of the parts of holder 1, namely the members 2,8, locking tabs 10,11, flange 4, hinges 6,7 etc. No assembly is required. Holder 1 can thus be manufactured quickly and at low cost.

I claim:

1. A napkin- or drape holder in the form of a one-piece molding, comprising:

a) a spring-like first plastic member having a body portion terminating in opposed proximal ends, said body portion being shaped to fit around the human neck;

b) a spring-like second plastic member having a body portion terminating in free ends, each of said free ends being connected to said body portion of said first member by integral plastic hinge means;

c) said first and second members having a normally open position in which said members lie in planes oblique to one another and a closed position in which said members are coplanar, said members being swingable about said hinge means between said positions;

d) said members being operable when in said closed position to clamp a napkin in place inserted between said body portions of said members; and e) integral plastic locking means carried by one of said members for releasably locking said members in said closed position.

2. Apparatus according to claim 1, wherein said locking means are provided by a pair of integral plastic tabs carried by one of said members that lie in the path of the other member as it is being swung from said closed position to said open position, said members being sufficiently resilient to allow said tabs to be displaced out of said path when said members are swung from said closed position to said open position.

3. Apparatus according to claim 1, wherein one of said members has an integral plastic stop means for stopping said members at the closed position as they are swingly moved thereto.

4. Apparatus according to claim 3, wherein said stop means is an integral plastic flange projecting from one member and overlying and lying in the path of the other member when said members are swung to the closed position.

* * * * *